United States Patent [19]

Kubacki et al.

[11] Patent Number: 4,635,545

[45] Date of Patent: Jan. 13, 1987

[54] APPARATUS FOR MARKING MOVING ARTICLES

[75] Inventors: Edward F. Kubacki, Marengo; John M. Masciale, Palatine, both of Ill.

[73] Assignee: American Can Company, Greenwich, Conn.

[21] Appl. No.: 685,717

[22] Filed: Dec. 24, 1984

[51] Int. Cl.[4] ..... B41F 17/00

[52] U.S. Cl. ..... 101/4; 101/44

[58] Field of Search ..... 101/39, 43, 44, 4, 41, 101/27

[56] References Cited

U.S. PATENT DOCUMENTS

| | | | |
|---|---|---|---|
| 2,819,671 | 1/1958 | Porter, Jr. et al. | 101/44 |
| 3,863,565 | 2/1975 | Patykula | 101/44 |
| 3,877,367 | 4/1975 | Norwood | 101/44 |
| 4,308,793 | 1/1982 | Schmidt | 101/44 |

*Primary Examiner*—Clifford D. Crowder

*Attorney, Agent, or Firm*—Paul R. Audet; Daniel M. Rosen

[57] ABSTRACT

Apparatus for marking continuously moving objects, wherein the marking device is caused to move during the marking process. The marking device may comprise a die guided to enable its movement with the object to a determined displacement, or, alternatively, the die may be externally controlled to move, through a given displacement, at the speed of the object.

4 Claims, 5 Drawing Figures

APPARATUS FOR MARKING MOVING ARTICLES

This invention is directed to a method and apparatus for marking moving articles. While the invention is particularly directed to the marking of moving cans on the conveyor or the like, by punching them with a die, it is apparent that the invention is also applicable to other stamping and/or printing devices employing a marking die, for marking cans or other articles.

It is frequently desirable to provide indicia on aluminum cans, during their manufacture. The marks may be employed, for example to identify a product to be filled in the cans, the dates of production of the cans, etc.

While such marking can be effected, for example by means by a punch at a fixed position in the production line for the cans, it is apparent that such marking techniques is undesirable since it requires periodic stopping of the conveyor or the like carrying the cans to be marked.

While the cans may be marked by punching, stamping or the like, employing a fixed guide directed to the cans at a determined position on the can conveying apparatus, the movement of the marking die of course cannot be instantaneous, and hence the continuous movement of the cans may result in blurring of the mark produced on the cans.

The present invention is therefore directed to an improved method and apparatus for the marking of articles, such as punching of cans, as they are conveyed on a conveying device, without requiring the stopping of the conveying device, while inhibiting blurring of the markings.

Briefly stated, in accordance with the invention, in order to avoid blurring of the marking on the moving article, means are provided for enabling the die to move with the object to be marked, at the same rate of speed, for a determined distance, during the operation of the marking die.

In one embodiment of the invention the movement of the die is effected by providing a guide for the die that enables a small displacement of the die in the direction of travel of the moving articles, whereby the die is permitted to move with the object during the marking thereof.

In another embodiment of the invention, the guide for the marking die is physically moved in the direction of travel of the articles to be marked, during the stamping procedure. This may be effected, for example, by providing a cam displaceable guide for the die, whereby cams provided for displacing the guides are moved in synchronism with the movement of the conveyor, to cause the die to move substantially at the speed of the conveyor, and in the same direction, during the marking process.

In order that the invention be more clearly understood, it will now be disclosed in greater detail with reference to the accompanying drawings, wherein.

Figure 1:
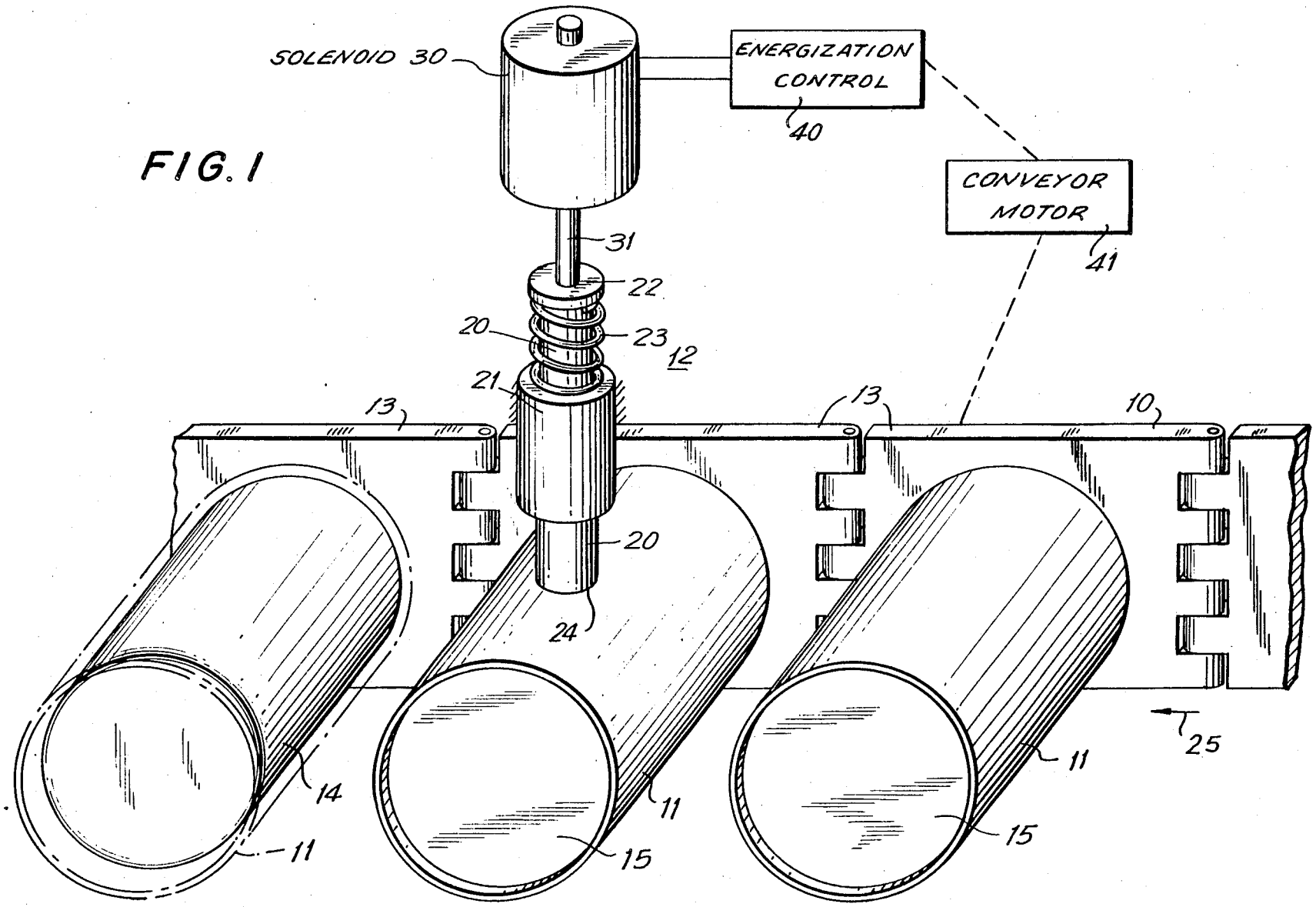
FIG. 1 is a simplified sketch, partially in cross-section of a can marking apparatus that may be employed in the invention.

Referring now to the drawings, and more in particular to FIG. 1, therein is illustrated, in simplified form, an apparatus for marking cans that may be employed in the system of the present invention. The apparatus of FIG. 1 includes a conveyor chain 10 for conveying cans, such as aluminum cans 11, past a marking station 12. While it is apparent that any conveying arrangement may be employed in accordance with the invention, the illustrated conveyor 10 is combined of a plurality of hinged links 13 each of which carries a dog 14 or other suitable projection for receiving and holding a separate can 11. The cans 11 thus have open ends towards the respective links 13, and closed ends 15 away from the respective links. The left hand can is shown in dashed lines, to more clearly illustrate the dog or projection 13 for transporting the can.

The marking apparatus is comprised of a die 20 extending substantially perpendicular to the axis of the cans, at a given location in the marking station 12. The die 20 is guided for axial movement by a guide 21, e.g., a guide bushing, affixed to the machine. The die 20 has an enlarged end 22 on the end thereof away from the cans, and a helical spring 23 extends between the enlarged end 22 and one end of the guide 21, to resiliently bias the guide away from the cans. If desired, of course, a fixed stop (not shown) may be provided to limit the movement of the die away from the cans.

A solenoid 30 is mounted with its armature 31 directed to engage the end of the enlarged portion 22 of the die. The physical engagement of the armature 21 with the enlarged end 22, in the non-marking position of the die, is of course unnecessary, it merely being necessary, in accordance with conventional practice, that the displacement of the armature 31 be adequate to force the die 20 against a can 11 at the marking station. In order to ensure that the solenoid is energized at the proper instant, i.e., only when a can 11 is position below the die 20, an energization control circuit 40 of conventional nature, for controlling the operation of the solenoid, may be synchronized, for example, with the conveyor drive motor 41. The synchronization may of course be effected by any conventional means, such as by cams or the like on the motor or conveyor, the use of sensors on the elements of the system, or by positive electrical control of the movement of the conveyor.

The specific elements employed in the illustration of FIG. 1 are of course not limiting to the invention, since the conveyor 10 and the projections 14 thereof may have an entirely different configuration, and the die 20 may be guided by guides of different configuration. The energization control may be effected by conventional means, such as disclosed, for example, in U.S. patent application Ser. No. 430,761 filed Sept. 30, 1982, and assigned to the assignee of the present application.

In the arrangement of FIG. 1, since the guide 21 is fixed, if the guiding surface of the guide 21 permits movement of the die 20 only in the axial direction of the guide, it is apparent that marking end 24 of the die may be in contact with the can during a given displacement of the can in the direction of the arrow 25, with the conveyor 10. Such contact during displacement of the can results in blurring of the marking on the can. This blurring will of course occur regardless whether the die is a punch for physically impressing the marking in the can, or a printing stamp for printing the marking on the can.

Figure 3:
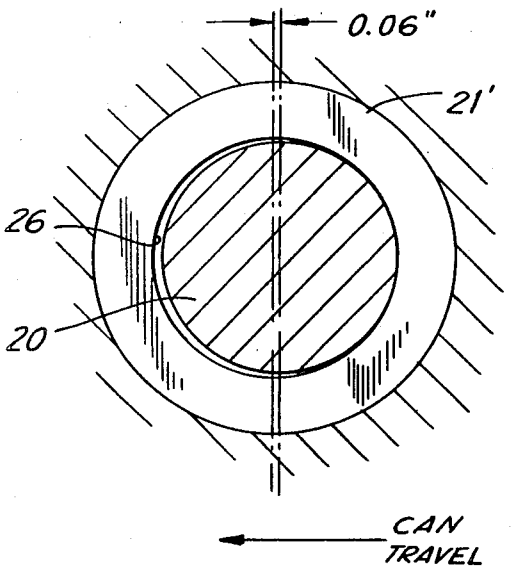
FIG. 3 is a partially cross-sectional view of the apparatus of FIG. 2, taken along the lines III—III.
Figure 2:
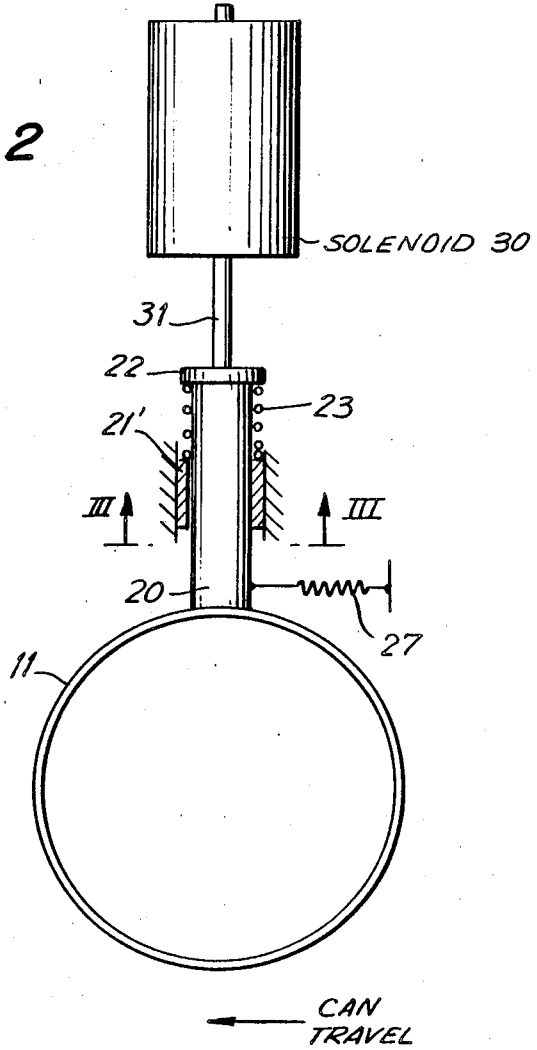
FIG. 2 is a simplified illustration of a portion of the apparatus of FIG. 1, in accordance with one embodiment of the invention, partially in cross-section.

In accordance with one embodiment of the invention, as illustrated in FIGS. 2 and 3, the guide or bushing 21 for guiding the guide 20, has an internal configuration to permit a slight amount of displacement in the direction of movement of the can. For example, if the guide 20 has a round cross-section as illustrated in FIG. 3, the cross-section of the die hole 26 in the guide 21' may be oblong. In the preferred embodiment of the invention, the guide 20 is resiliently biasd, for example, by means of a spring 27, against the side of the guide hole 26 opposite the direction of the can. With this arrangement, when the solenoid is energized to drive the die into contact with the can, it is initially guided along one side of the guide hole 26. As soon as the die 20 contacts the can, it is carried by the can through a determined displacement, the displacement being adequate to permit withdrawal of the die from the can as soon as or before the die strikes the opposing guiding surface of the guide 21.

In one embodiment of the invention, for example, the long transverse axis of the guide hole 26 was about 0.06 inches greater than the diameter of the die.

It is of course apparent that other cross-sectional configurations may be employed for the die and the guide, such as, for example only, rectilinear cross-sectional configurations. In each case, however, the guide hole must be configured to permit a small displacement of the die in the direction of movement of the can.

Figure 5:
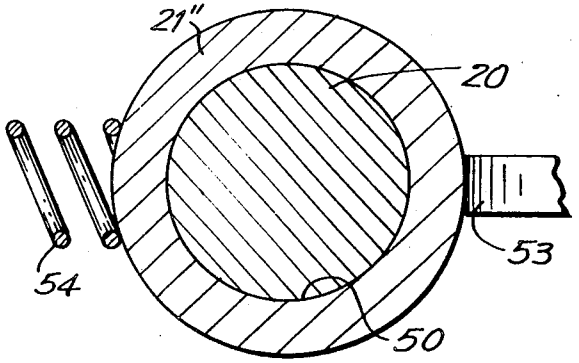
FIG. 5 is a cross-sectional of a portion of the apparatus of FIG. 4, taken along the lines V—V.
Figure 4:
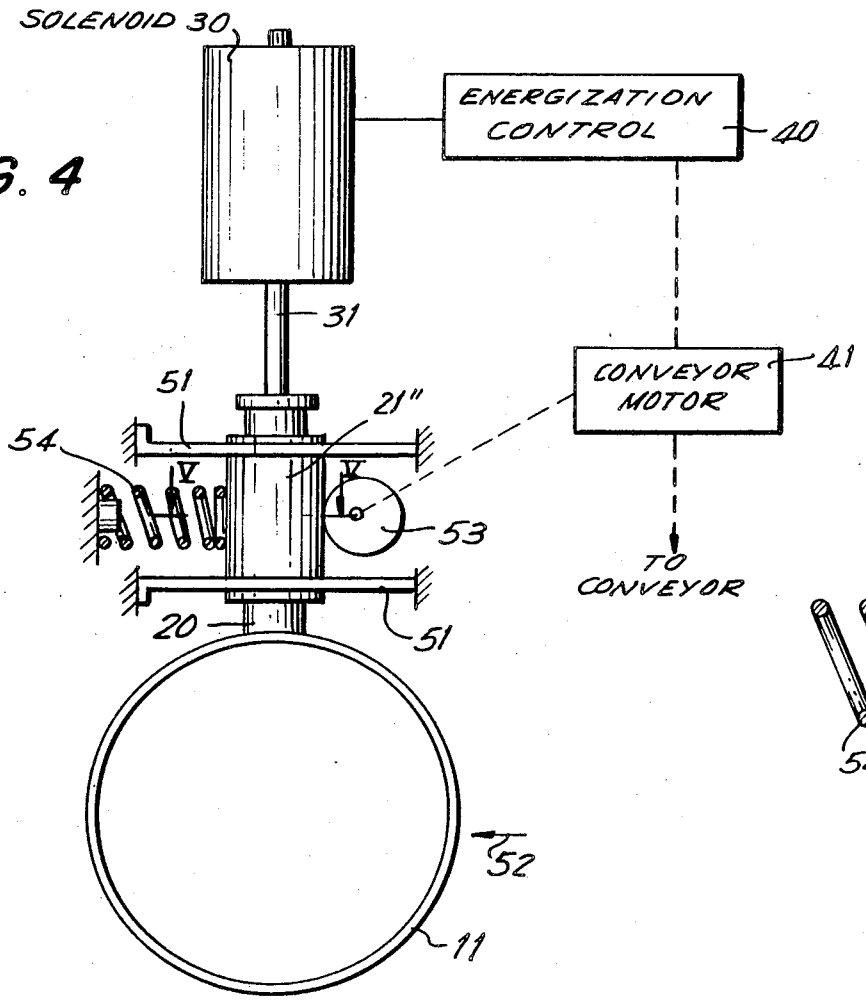
FIG. 4 is a simplified illustration of a further embodiment of the invention; which may be employed in combination with the apparatus of FIG. 1.

In a further embodiment of the invention, as illustrated in FIGS. 4 and 5, the guide 25 has a guide hole 50 dimensioned to permit only axial movement of the die. In this arrangement, however, the guide 21" is slidably mounted in slides 51 of any conventional construction, to permit displacement of the guide 21" in the direction of the movement of the cans, as indicated by arrow 52.

A cam 53 is controlled directly or indirectly by the conveyor motor 41, to vary the displacement of the guide 21" in the direction 52 so that, just prior to the initiation of energization of the solenoid 30 the die 20 is controlled to start a leftward movement (as seen in FIG. 4) to obtain substantially the speed of the cans in the direction 52. The die 20 hence is moving at the speed of the can 11 at the time it initially strikes the can, the cam 53 enabling the die to continue such movement until it is released from contact with the can. Suitable resilient means are provided such as spring 54, acting between a fixed base 55 and the guide 21", to hold the guide 21" against the cam 53 in conventional manner.

While the invention has been specifically described with reference to the use of a moveable die, such as a punch or stamp, for marking the can, it is apparent other known marking devices may be employed, such as, for example, a non-contact marking device. For example, a laser may be employed to etch markings into the side of the can. In such an arrangement the laser may be displaced by a can or the like, in the manner illustrated in FIG. 4 or, alternatively, mirrors may be provided, controlled by suitable cans, or the like, in order to move the laser beam with the can.

While the invention has been described and disclosed with reference to a limited number of embodiments, it is apparent that variations and modifications may be made therein, and it is therefore intended in the following claims to cover each such variation and modification as falls within the true spirit and scope of the invention.

What is claimed is:

1. In an apparatus for marking an object with a punching or printing die, wherein conveying means are provided for moving said object in a given direction, fixed guide means are mounted on said apparatus for guiding said die for movement transverse to said given direction to contact and mark said object, and means are provided to direct said die toward said object, the improvement wherein said fixed guide means and die are shaped with clearance to permit limited displacement of said die relative to said fixed guide in said given direction, and further comprising means biasing said die in a direction opposite to said given direction, said die being carried by said object through said limited displacement and blurring of said mark is inhibited.

2. In an apparatus for marking objects, including conveyor means for conveying said objects in a given direction past a marking station, marking means at said station including a marking device, and guide means for guiding said marking device for movement transverse to said given direction to contact and mark said objects as they pass said station; the improvement wherein said guide means and said marking device have clearance therebetween enabling movement of said marking device through a determined displacement with respect thereto in said given direction, said marking device being movable by said objects through said given displacement, said guide means comprising bushing means having an aperture with an elongated cross section receiving said marking device and enabling said marking device to move with said objects a determined distance in said given direction during the marking of said objects.

3. In an apparatus for marking objects, including conveying means for conveying said objects in a given direction past a marking station, marking means at said station including a marking device, and a guide means mounted on said apparatus including means for guiding said marking device for movement relative to said means for guiding and transverse to said given direction to mark said objects as they pass through said station; the improvement wherein said guide means further comprises means for controlling said marking device and said means for guiding to be moved independently of said objects relative to said guide means through a determined displacement in said given direction during marking of said objects, whereby blurring of markings made thereby on said objects in inhibited.

4. The apparatus of claim 3 wherein said marking device passes through said means for guiding and has a circular cross section therein and said means for guiding comprises means having an elongated cross section aperture for enabling said marking device to move with said objects a given displacement in said given direction.

* * * * *